United States Patent [19]

Kanelous

[11] 3,998,380

[45] Dec. 21, 1976

[54] CARTON HAVING AN OPENABLE AND CLOSEABLE POUR OPENING

[76] Inventor: Kanelos John Kanelous, 22 North Forest Ave., Rockville Centre, N.Y. 11570

[22] Filed: Dec. 16, 1975

[21] Appl. No.: 641,237

[52] U.S. Cl. ..... 229/17 R; 229/51 D

[51] Int. Cl.[2] ..... B65D 5/72; B65D 5/54

[58] Field of Search ..... 229/17 R, 17 G, 51 D, 229/7 R

[56] References Cited

UNITED STATES PATENTS

| | | | |
|---|---|---|---|
| 2,468,123 | 4/1949 | Shima | 229/17 R X |
| 3,107,839 | 10/1963 | Kauffeld | 229/17 R |
| 3,175,749 | 3/1965 | Elias | 229/17 R |
| 3,269,644 | 8/1966 | Bump | 229/17 R |
| 3,458,111 | 7/1969 | Leasure et al. | 229/17 R |
| 3,672,557 | 6/1972 | Krzyzanowski | 229/17 R |
| 3,861,577 | 1/1975 | Druyts | 229/51 D X |
| 3,883,066 | 5/1975 | Smith | 229/17 R |

*Primary Examiner*—Davis T. Moorhead
*Attorney, Agent, or Firm*—Kirschstein, Kirschstein, Ottinger & Frank

[57] ABSTRACT

A carton having a rectanguloid, cylindrical or other conventional shape formed from suitable material has a plurality of walls arranged to define a container body. One of the plurality of walls of the container body is provided with a section having two panels arranged in a gradually deepening infolded V shape beginning at a point within the one wall and extending to another of the plurality of walls intersecting and adjacent the one wall, the section being of its greatest depth at the intersecting adjacent wall. A pull tab extends along the axial centerline of the section. In one embodiment tabs are adhesively joined to the panels and are attached along the edge of the intersecting adjacent wall along lines of weakening. In alternative embodiments, the panels are attached to the edge of the intersecting adjacent wall along lines of weakening.

To open the carton, an outwardly directed force is exerted on the pull tab and the tabs or, as in the alternative embodiments the panels, will separate from the intersecting adjacent wall along the lines of weakening. The panels will articulate outwardly about the centerline of the section to form a pour opening in the carton.

To close the carton, an inwardly directed force is exerted on the pull tab and the panels will articulate inwardly about the centerline to close the pour opening.

11 Claims, 13 Drawing Figures

FIG. 1
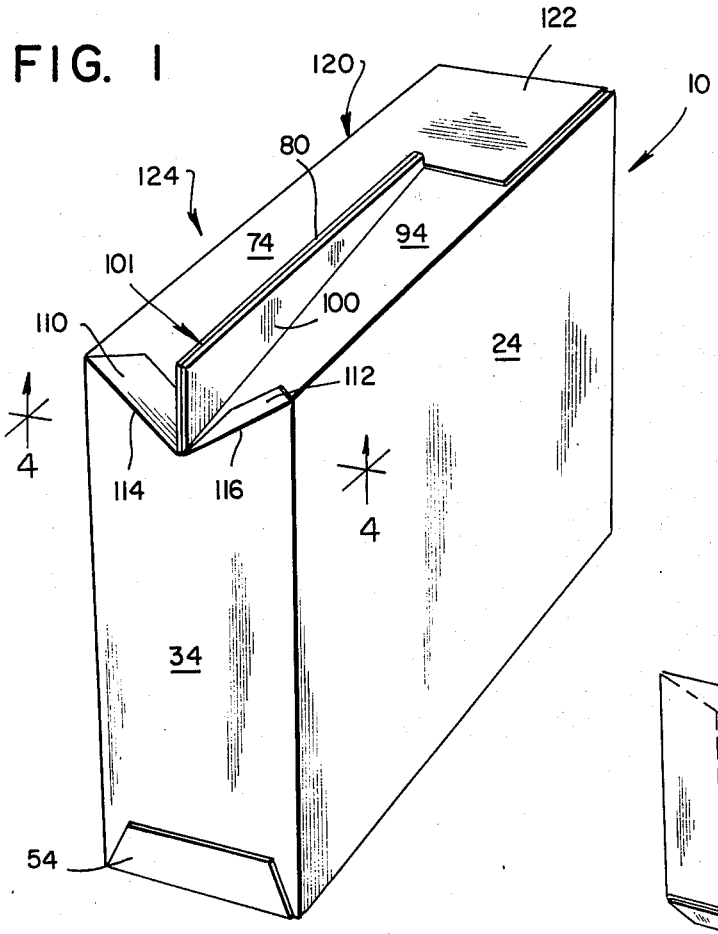
FIG. 6
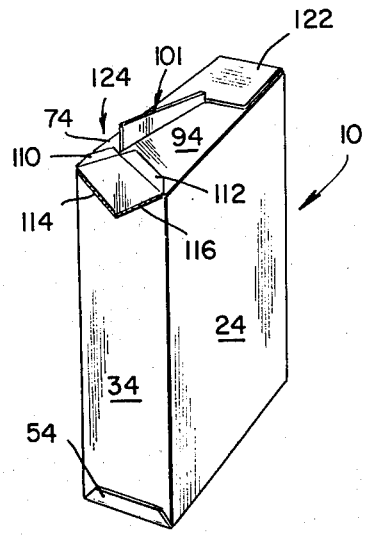
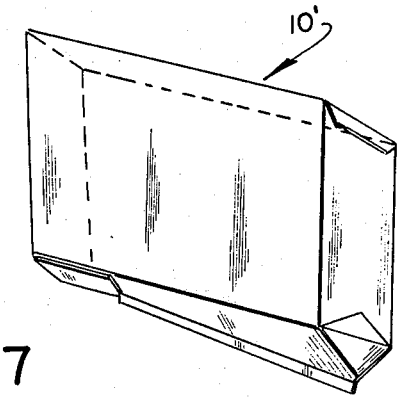
FIG. 7
FIG. 4
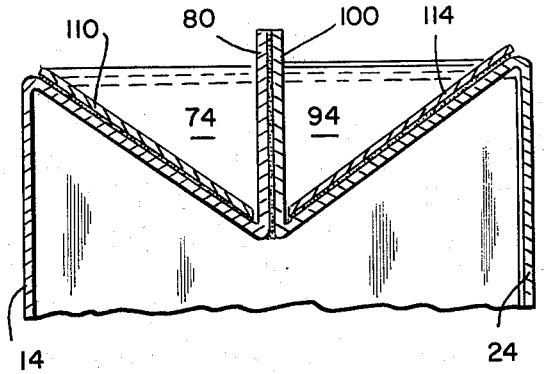

CARTON HAVING AN OPENABLE AND CLOSEABLE POUR OPENING

BACKGROUND OF THE INVENTION

1. Field of the Invention

The invention relates to a carton and more particularly to a carton having a wall construction providing an easily openable and closeable pour opening.

2. Prior Art

There are many types of cartons in the prior art which are provided with wall structures having openable and closeable pour openings therein. In one type of carton a line of weakening is provided in a side wall spaced from but near the top wall. By inserting a finger or other dull object along the line of weakening an opening in the side wall is created. The top wall is then pulled away from the side wall to form an opening in the container through which the contents of the container may be poured. The problem with this container structure is that the portion of the top separated from the end wall does not always return easily to the closed position to effectively seal the opening.

Another type of prior art carton provides a wall construction in which a pour spout is created by pulling on a tab formed in the wall. One such prior art carton is disclosed in U.S. Pat. No. 3,672,557 to Krzyzanowski in which one wall of the carton is constructed of two panels hinged along the centerline to form a V shaped infolded carton wall. A transverse fold line is provided in the wall which permits a portion of the wall to be hinged to form a pour spout. The hinged portion of the wall is secured to the top wall of the container along a line of weakening. When the hinged portion of the wall is pulled outwardly it separates from the top wall of the carton to create an opening through which the contents of the carton may be poured. While this structure eliminates the complex die cutting that is needed to form the panels necessary for the pour spout and the non-standard gluing procedures necessitated by the difficult and unusually shaped panels in many of the prior art cartons the pour spout created by this structure is constricted thereby limiting the amount of contents which can pass therethrough. Further, this construction requires an awkward and unusual manipulation of the carton to permit the contents to be poured from the carton when the pour spout is opened.

Moreover, none of the prior art structures are easily adaptable to cartons which are formed from moldable materials such as polyethelene or polyvinyl chloride.

It is toward the elimination of these and other difficulties that the present invention is directed.

SUMMARY OF THE INVENTION

1. Purposes of the Invention

It is an object of the present invention to provide a carton having a pour opening that is of an uncomplicated structure and which can be assembled easily by operations customary to the erection of paperboard cartons.

Another object of the present invention is to provide a pour opening of an uncomplicated structure for a carton which is formed from a moldable material.

Still another object of the present invention is to provide a carton with a pour opening in which the opening can be easily opened and closed.

Yet another object of the present invention is to provide a carton with a pour opening in which the pour opening, when closed, effectively seal the carton.

A further object of the present invention is to provide a carton with a pour opening in which the contents may be poured from the carton easily, without awkward unnatural manipulation of the carton.

A still further object of the present invention is to provide a carton with a pour opening in which the carton is of a rectanguloid or right circular cylindrical shape.

A yet further object of the present invention is to provide a carton with a pour opening which can be easily and economically manufactured.

Other objects of the invention in part will be obvious and in part will be apparent in the following description.

2. Brief Description of the Invention

Generally speaking, a carton has a plurality of walls arranged to define a container body. The carton is formed from a suitable semi-stiff material and in one embodiment has a rectanguloid shape formed by folding a carton blank. In alternative embodiments the carton is formed from a moldable material e.g. plastic by conventional molding techniques and has a rectanguloid or a right circular cylindrical shape. One of the walls of the container body has a section therein formed by a pair of panels. The section has an infolded V shape beginning at a point within the wall and extending to another of the plurality of walls which is adjacent to and which intersects the one wall. The section has its greatest depth at the intersecting adjacent wall. A pull tab extends along the axial centerline of the section of the wall. In the one embodiment wherein the carton is formed from a single carton blank, closure tabs are attached to the edge of the intersecting adjacent wall along lines of weakening and are adhesively joined to the panels along their edges. In the alternative embodiments wherein the carton is formed by molding techniques the panels are attached to the edge of the intersecting adjacent wall along lines of weakening.

To open the carton an outwardly directed force is exerted on the pull tab and the closure tabs, or in the alternative embodiments the panels, will separate along the lines of weakening from the intersecting adjacent wall. The panels will articulate outwardly about the axial centerline of the section to create a pour opening. Since the carton material is semi-stiff, the opening will remain open without the need for continuous pulling on the pull tab.

To close the carton an inwardly directed force is exerted on the pull tab and the panels portion will articulate inwardly about the axial centerline of the section to close the pour opening.

The invention consists in the features of construction and arrangement of parts which will be detailed hereinafter and which will be described in the appended claims.

BRIEF DESCRIPTION OF THE DRAWINGS

For a better understanding of the above invention reference should be had to the accompanying drawings wherein like numerals of reference indicate similar parts throughout the several views and wherein:

FIG. 1 is a perspective view of a carton in accordance with one embodiment of the present invention;

FIG. 4 is an enlarged sectional view taken substantially along the line 4—4 in FIG. 1;

FIG. 6 is a perspective view, at a slightly reduced scale, of a carton in which a pour opening is formed in the top and end walls in accordance with the present invention;

FIG. 7 is a perspective view at a slightly reduced scale of a carton similar to the carton illustrated in FIG. 1 wherein the top and end walls constructed in accordance with the present invention form a pour spout;

DESCRIPTION OF THE PREFERRED EMBODIMENT

Figure 2:
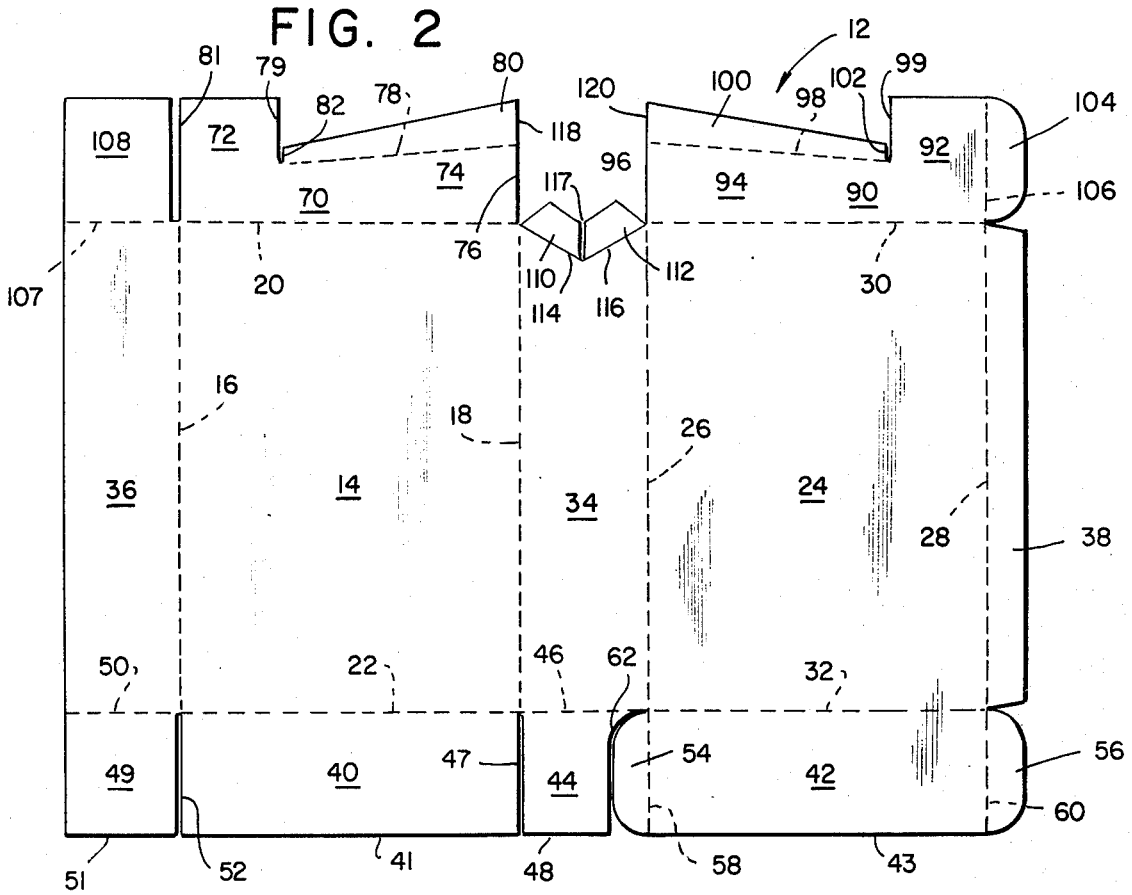
FIG. 2 is a plan view of a blank for erection into the carton illustrated in FIG. 1.

Referring now in detail to the drawings the reference numeral 10 denotes a carton structure in accordance with one embodiment the present invention. The carton 10 is made from a carton blank 12 (shown in FIG. 2) subsequently to be described. The carton blank 12 is a single carton blank i.e. a blank consisting of only one piece of semi-stiff yet light weight paperboard, e.g. cardboard. It will be appreciated by those skilled in the art that other foldable semi-stiff sheet material may be employed such as plastic. Moreover, the carton may be constructed by using molding methods e.g. injection molding or vacuum molding which are well known in the art as will be described hereinafter in detail. The single carton blank 12 is made from a larger piece of such material in a conventional manner, as, for instance, with steel rules which cut out the form of the blank, cut out the various openings in the blank and crease the fold lines within the blank.

With reference to FIG. 2 there is illustrated the single carton blank 12 which includes a rectangular portion that is divided by a series of spaced vertical fold lines and spaced horizontal fold lines into various wall panels and flaps. A first side wall panel 14 is formed by the vertical fold lines 16 and 18 and the horizontal fold lines 20 and 22. A second side wall panel 24 is formed by the vertical fold lines 26 and 28 and the horizontal fold lines 30 and 32 which are coextensive and collinear with horizontal fold lines 20 and 22 respectively. The vertical fold lines 16, 18, 26 and 28 are parallel to and coextensive with each other and perpendicular to the horizontal fold lines. A first end wall panel 34 lies between the first and second side wall panels 14 and 24 and is hinged thereto along fold lines 18 and 26 respectively. A second end wall panel 36 is hingedly joined to the first side wall panel 14 along the vertical fold line 16. The second side wall panel 24 is provided with glue flap 38 hingedly connected thereto along the vertical fold line 28. Bottom closure means or flaps are joined to the side and end wall panels. A first bottom closure flap 40 has an edge 41 which runs parallel to and is coextensive with the horizontal fold line 22. The first bottom closure flap 40 is attached to the lower edge of the first side wall panel 14 along the fold line 22. A second bottom closure flap 42 has an edge 43 which runs parallel to and is coextensive with the horizontal fold line 32. The edge 43 is collinear with the edge 32. The second bottom closure flap 42 is hinged to the lower edge of the second side wall panel 24 along fold line 32. The edges 41 and 43 are spaced from the horizontal fold lines 22 and 32 so that the width of the first and second bottom closure flaps is equal to the width of the side wall panels 34 and 36. A third bottom closure flap 44 is hinged along fold line 47, which is collinear with the horizontal fold lines 22 and 32, to the lower edge of the first end wall panel 34. The third bottom closure flap 44 is detached from the first bottom closure flap 40 along the slit 47 which is collinear with the vertical fold line 18 and has an edge 48 which runs parallel with the fold line 46 and is collinear with edges 41 and 43. The second end wall panel 36 has a fourth bottom closure flap 49 attached thereto along fold line 50 which is collinear with the horizontal fold lines 22, 32, and 46. The fourth bottom closure flap 49 has an edge 51 which is collinear with the edges 41, 43 and 48 and is detached from the first bottom closure flap 40 along the slit 52 which is collinear with the vertical fold line 16. In order to permit the carton to be erected in a manner which will hereinafter be described, the second bottom closure flap 42 is provided with glue tabs 54 and 56 which are hingedly attached thereto along the fold lines 58 and 60 respectively. The fold lines 58 and 60 are collinear with the vertical fold lines 26 and 28 respectively. The tab 54 is nested in the third bottom closure flap 44 and is separated therefrom by slit 62.

The foregoing is familiar to the carton art and the present invention resides in the construction and arrangement of the flap means attached to the upper edges of the first and second side wall panels 14 and 24 to form a top wall on the carton and the tab structure attached to the first end wall panel 34 as described hereinbelow.

A first top closure flap 70 is hingedly attached to the first side wall panel 14 along the horizontal fold line 20. The first top closure flap 70 is divided into a first panel 72 and a second panel 74. The second panel 74 has an edge 76 which is collinear with the vertical fold line 18. For reasons which will become apparent as this description proceeds, the edge 76 has a length equal to more than half the width of the first end wall panel 34. Extending away from the edge 76 toward the first panel 72 and running obliquely to fold line 20 is a first oblique fold line 78. The first oblique fold line 78 terminates at a transverse edge 79 of the first panel 72. Hinged to the panel 74 along the first oblique fold line 78 is a strip 80 which is separated from the first panel 72 along edge 82. The transverse edge 79 is equal, in length, to one half the width of the first end wall panel 34. The other edge 81 of the first panel 72 is collinear with the vertical fold line 16 and is equal in length to the width of the first end wall 34. The transverse edge 79 runs parallel to the edge 81 and preferably is spaced therefrom approximately 30 percent of the length of fold line 20. Similarly, hingedly attached to the second side wall panel 24 along the horizontal fold line 30 is a second top closure flap 90 having a first panel 92 and a second panel 94. The second panel 94 has an edge 96 which is collinear with the vertical fold line 26 and is equal in length to edge 76. Extending away from the edge 96 toward the first panel 92 and running obliquely to the horizontal fold line 30 is a second oblique fold line 98. The second oblique fold line 98 terminates at a transverse edge 99 of the first panel 92. A strip 100 is hinged to panel 94 along the second oblique fold line 98 amd is separated from the first panel 92 along edge 102. The tranverse edge 99 is equal in length to transverse edge 79. A glue tab 104 is attached to the first panel 92 along a fold line 106 which is collinear with fold line 28. The transverse edge 99 runs parallel to the fold line 106 and preferably is spaced therefrom a distance equal to the distance transverse edge 79 is spaced from edge 81. Attached to the second end wall panel 36 along a fold line 107 which is collinear with horizontal fold line 20 may be a top closure panel 108. The top closure panel 108 is separated from the first panel 72 of the first top closure flap 70 along the edge 81. The edges 82 and 102 preferably, are equal in length.

The upper edge of the first end wall panel 34 i.e. the edge opposite the horizontal fold line 46 is provided with a pair of closure tabs 110 and 112 which are formed by lines of weakening 114 and 116 respectively and which are separated from each other by a slit 117. The line 114 begins at the point of intersection of the horizontal fold line 20, the vertical fold line 18 and the edge 76 and extends inwardly into the first end wall panel 34 toward the axial centerline of the first end wall panel. Similarly, the line 116 begins at the point of intersection of the horizontal fold line 30, the vertical fold line 26 and the edge 96 and extends inwardly into the first end wall panel 34 toward the axial centerline of the first end wall panel. The lines 114 and 116 intersect at the axial centerline of the first end wall panel 34. For reasons which will become apparent as the description proceeds, the length of each of the lines 114 and 116 is equal to the length of each of the edges 76 and 96 respectively and the length of the slit 117 preferably, is equal to the length of edges 118 and 120 of the strips 80 and 100 respectively. The edges 118 and 120 may be collinear with edges 76 and 96 respectively. It has been found that the length of the slit 117 should be at least 30 percent of the width of the first end wall panel 34 in order to easily open the carton as herein below described.

The lines 114 and 116 are lines of weakening which will permit the closure tabs 110 and 112 to separate from the first end wall panel 34 in a mannner to be hereinafter described. The lines of weakening 114 and 116 preferably are perforated and can be die-cut by suitably mechanisms and may consist of a group of spaced slits or a series of perforations. It will be appreciated by those skilled in the art that other methods of forming the lines of weakening 114 and 116 may be used as long as they form a weakened line or a zone along which the tabs may be separated from the first end wall panel 34.

Figure 3:
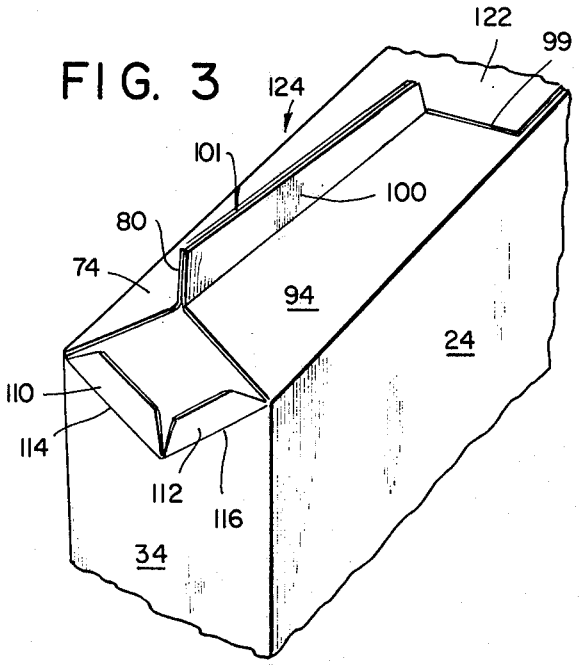
FIG. 3 is perspective view of a portion of a partially erected carton.

The carton in various stages of its erection is illustrated in FIGS. 1, 3, and 4 and has a rectanguloid container body including first and second side walls or wall panels 14 and 24 connected along one end by the first end wall or wall panel 34. The first and second side wall panels 14 and 24 are joined along the opposite end by first folding glue tab 38 toward the first side wall panel 14 and folding the second end wall panel 36 toward the second side wall panel 24 to close the open end. The glue tab 38 is then adhesively secured to the inside surface of the second end wall panel 36. The bottom is closed by first holding the third bottom closure flap 44 inwardly across one open end of the carton, folding the fourth bottom closure flap 49 over the opposite end and adhesively securing the inner surface of the first bottom closure flap 40 to the first and second bottom closure flaps after it is folded over the opening. The second bottom closure flap 42 then is folded over and adhesively secured to the first bottom closure flap 40. Glue tab 54 is then folded over and adhesively secured to the first end wall panel 34 and thereafter glue tab 56 is secured to the second end wall panel 36. The procedure thus far described is one usually followed in erecting a container body from a single blank of material. It will be appreciated that deviation from the specific order in which the various panels, flaps and tabs immediately heretofore mentioned are adhesively secured to construct the partially erected container body will not detract from the present invention.

Figure 5:
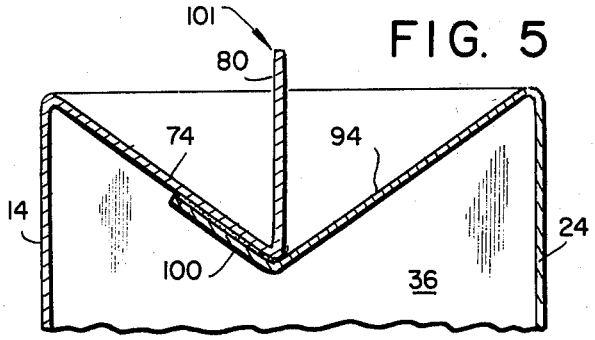
FIG. 5 is an enlarged sectional view similar to FIG. 4 but illustrating an alternative construction.

The top of the container body is closed by first folding top closure panel 108 inwardly. The first and second top closure flaps 70 and 90 are then folded over the open top with the first panel 72 of the first top closure flap 70 being placed between the first panel 92 of the second top closure flap 90 and the top closure panel 108. The strips 80 and 100 are then adhesively secured to each other to form a pull tab 101 so that the second panels abutt each other along the oblique fold lines 78 and 98, the first panel 72 is secured to the top of the top closure panel 108 and the first panel 92 is secured to the top of the first panel 72. The glue flap 104 is then adhesively secured to the second end wall panel 36. There is illustrated in FIG. 5 an alternative construction in which the strip 100, instead of being secured to the strip 80, is secured to the inner surface of the second panel 74 of the first top closure flap 70. In this embodiment the pull tab 101 consists, therefore of strip 80.

Since the edges 76 and 96 are equal in length and are each greater than one half the width of the first end wall 34, when the first and second top closure flaps 70 and 90 are secured at the first panels 72 and 92 respectively, the second panels 74 and 94 will not be coplaner and will create an inverted V shaped rise in the top wall 120 of the carton as best seen in FIG. 3. The top wall 120, therefore has a first section 122 which is substantially flat e.g. the section formed by th secured first panels 72 and 92 of the first and second top closure flaps 70 and 90 respectively since the widths of these panels equals the width of the first end wall 34. This first section 122 conforms to the general configuration of the carton. A second section 124 of the top wall 120 will not be flat but will be of either gradually rising inverted V shape or as will be hereinafter described, a gradually deepening V shape beginning at the transverse edges 79 and 99, with its greatest rise or depth at the end adjacent the intersecting adjacent first end wall 34.

To complete the erection of the carton, a downward force is exerted on the pull tab 101 which lies along the axial centerline of the second section. The side wall and end walls, being made from a semi-stiff material, will deform permitting the second panels 74 and 94 to articulate about the axial centerline of the second section of the carton top thereby placing the edges 76 and 96 adjacent the lines 114 and 116 respectively. The first section of the top formed by the adhesively joined panels 72 and 92 will not articulate but will remain in its normal condition i.e. flat. The closure tabs 110 and 112 are then folded onto and adhesively secured to the outer surfaces of the second panels 74 and 94 respectively as shown in FIGS. 1 and 4. In an alternative embodiment (not shown) the closure tabs 110 and 112 can be folded inwardly prior to forcing downward on the joined strips 80 and 100. The tabs are then adhesively sealed to the inner surface of the second panels. As mentioned hereinabove, the edges 118 and 120 of the strips 80 and 100 are equal in length to the length of the slit 117 so that when the carton is in the fully erected condition, the tab 101 will not project above the upper edges of the side and end walls.

A carton constructed in accordance with the present invention which has already been filled with a desired material is supplied to an individual in a sealed condition as illustrated in FIG. 1. To open the carton, an individual merely grasps the carton in one hand and holds it in its upright position. Then, by pulling outwardly on the pull tab 101 the tabs 110 and 112 are severed from the intersecting adjacent first end wall 34 along the lines 114 and 116. The tabs remain attached to the second panels 74 and 94 because of their adhesive joinder thereto. This permits the individual to pull the second panels 74 and 94 outwardly which causes the panels to articulate about the axial centerline of the top to form a pour opening as illustrated in FIG. 6. Since the carton material is semi-stiff and since the edges 76 and 96 are each more than one half the width of the end wall 34, the pour opening remains in the open condition without the need to continually pull upwardly on the tab 101.

Once the carton is in the condition of FIG. 6, the individual is able to tilt it and pour all or a portion of the contents from the pour opening in the usual manner. The material packaged in the carton may be contained inside the carton or packaged in a pouch or liner carried inside the carton to preserve freshness. When the contents of the carton are packaged in a pouch or liner, this inner liner will have to be opened before the contents can be dispensed. It will be appreciated by those skilled in the art that the inside surfaces of the carton may be treated to enhance the storage quality of the carton.

If the individual only dispenses a portion and not all of the contents of the carton, the carton is easily reclosed to protect the remaining contents. To reclose the carton, the tab 101 is urged inwardly into the carton causing the second panels 74 and 94 to articulate about the axial centerline of the second section. The stiffness of material forces i.e. snaps the second panels 74 and 94 downwardly into the carton so that the edges 76 and 96 are brought adjacent the edges of the first end wall 34 formed by the lines 114 and 116 to effectively seal the carton.

An obvious modification of the embodiment set forth is that the carton 10, instead of having the infolded V shaped section as hereinabove described in its top wall, may be provided with the infolded section in one of its end walls with the closure tabs joined to the intersecting adjacent top wall along lines of weakening. When pulled outwardly, the section forms a pour spout in the carton 10 as shown in FIG. 7.

While the above discussion concern itself with a carton defined by walls which are arranged by folding a single carton blank of for example, paperboard material, cartons formed of semi-stiff material by other methods may be provided with the feature of the present invention.

Figure 8:
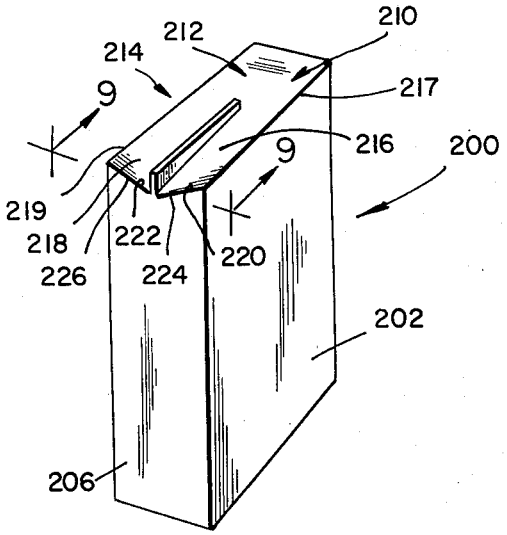
FIG. 8 is a perspective view at a slightly reduced scale of a carton in accordance with an alternative embodiment of the present invention.
Figure 9:
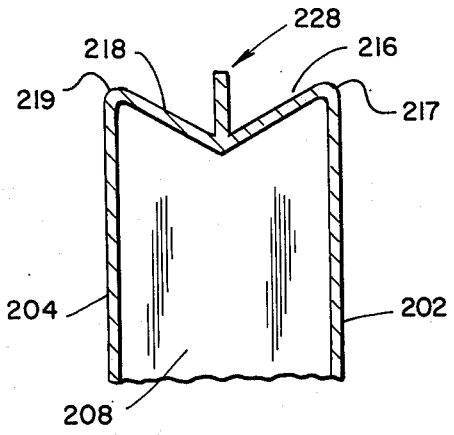
FIG. 9 is an enlarged sectional view taken substantially along the line 9—9 in FIG. 8.

There is illustrated in FIGS. 8 and 9 an alternative embodiment in which a carton is formed from a plastic material by well known molding methods as, for example, injection or vacuum molding. In this embodiment the wall structure to be described is molded as an integral unit. The carton 200 resembles the carton 10 and has side walls 202 and 204 and end walls 206 and 208. While not shown, it will be appreciated that the bottom of the carton is closed by suitable bottom closure means to form a container body.

The top wall 210 of the carton 200 has a generally flat area 212 and a section 214 which has an infolded V shape extending from the first portion 212 within the top wall 210. The section is of varying depth, being deepest at the intersecting adjacent end wall 206. The section 214 is formed by panels 216 and 218 which are hingedly connected to the upper edges 217 and 219 of the side walls 202 and 204 respectively. Since the carton is molded as a unit, the hinged connections may be accomplished easily by reducing the thickness of the material in the carton wall along the edges 217 and 219. The wall thickness is sufficient to permit the panels 216 and 218 to be hingedly connected to the side walls while preventing the panels from separating from the side walls when the panels are subjected to an outwardly directed force as will hereinafter be described. The upper edge of the intersecting adjacent end wall 206 conforms to the V shape of the portion 214. The panels 216 and 218 are joined to the end wall 206 at their edges 220 and 222 along lines or zones of weakening 224 and 226 to permit the panels 216 and 218 to separate from the end wall 206 to form a pour opening. The edges 220 and 222 are equal in length and are each greater than one half the width of the end wall 206. The lines or zones of weakening may be perforated or may be created by molding the carton with an extremely thin wall thickness at these areas. Extending along the axial centerline of section 214 is a pull tab 228 which is integrally formed with the panels.

To open the carton 200 an outwardly directed force is exerted on the pull tab 228 which results in the panels 216 and 218 separating from the intersecting adjacent end wall 206 along the lines 224 and 226. The panels 216 and 218 will articulate outwardly about the axial centerline of section 214 to form a pour opening in the carton 200. Since the carton material is semi-stiff and since the edges 220 and 222 are each more than one half the width of the end wall 206, the pour opening remains in the open condition without continually pulling outwardly on the tab 228. To close the carton an inwardly directed force is exerted on the tab 228 and the panels 216 and 218 will articulate inwardly about the centerline of section 214 and due to the stiffness of the carton material will snap into their infolded V configuration.

As was discussed hereinabove regarding the carton formed from folding the single carton blank, the infolded V shape section 214 may be provided in a side wall of the carton 200 so that, when the pour opening is created, a pour spout is formed in the carton which would be identical to that illustrated in FIG. 7.

Figure 10:
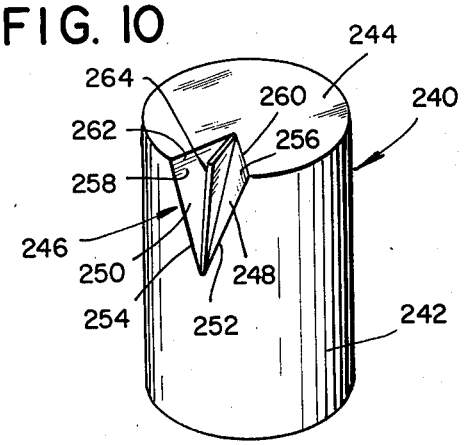
FIG. 10 is a perspective view at a slightly reduced scale of a carton in accordance with another alternative embodiment of the present invention.

While the immediately proceeding discussion concerned a carton having a generally rectangular shape formed by molding techniques, the same effect can be achieved in a molded carton having a cylindrical shape. There is shown in FIG. 10 a carton 240 folded with a generally right circular cylindrical side wall 242 and flat top and bottom walls molded as a unit. Formed in the side wall 242 and the intersecting adjacent top wall 244 is a panel structure similar to the panel structures hereinabove discussed. A section 246 is formed in the side wall 242 by panels 248 and 250 which extend from a point within the side wall to the top wall 244. The section 246 has a gradually deepening infolded V shape with is greatest depth at the intersecting adjacent top wall 244. The panels 248 and 250 are hingedly connected along edges 252 and 254 respectively to the side wall 242. The panels 248 and 250 are attached to the edge of the top wall 224 along their edges 256 and 258 respectively by lines or zones or weakening 260 and 262 respectively. Extending along the axial centerline of the section 246 is a pull tab 264.

Figure 11:
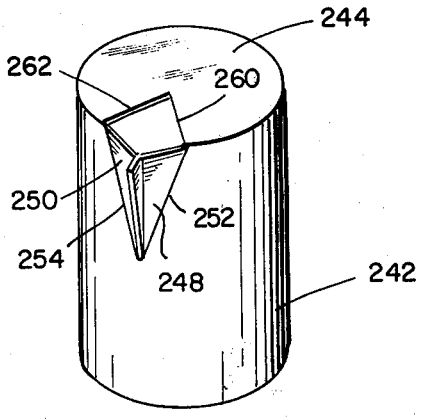
FIG. 11 is a view similar to FIG. 10 in which a pour opening is formed in the top and side walls of the carton.

To open the carton an outwardly directed force is exerted on the pull tab 264 resulting in the panels 248 and 250 separating from the top wall 244 along the lines of weakening. Since the carton is formed from semi-stiff material the carton walls will deform slightly permitting the panels 248 and 250 to articulate about the centerline of section 246 to create a pour spout as shown in FIG. 11. The pour spout will remain in its opened condition without continually pulling outwardly on the tab 264.

To close the pour spout, an inwardly directed force is exerted on the pull tab 264 resulting in the panels 248 and 250 snapping inwardly due to the stiffness of the carton material. Their edges 256 and 258 will again be brought adjacent the top wall 244.

Figure 12:
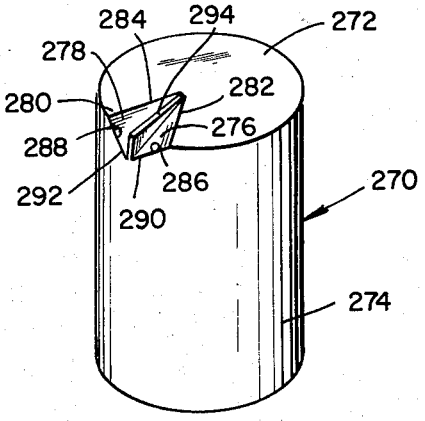
FIG. 12 is a perspective view similar to FIG. 10 illustrating yet another alternative embodiment of the present invention.

There is illustrated in FIG. 12 yet another alternative embodiment wherein a molded cylindrical carton 270 is provided with a generally flat top wall 272 and a right circular cylindrical side wall 274 which intersects and is adjacent to the top wall 272. Extending radially outwardly from the center of the top wall 272 are two panels 276 and 278 which form an infolded V shaped section 280 in the top wall. The section 280 is of its greatest depth immediately adjacent the side wall 274. The panels 276 and 278 are hingedly attached along their edges 282 and 284 respectively to the top wall and are joined to the side wall 274 at their edges 286 and 288 along lines or zones of weakening 290 and 292 respectively. A pull tab 294 is integrally formed with the panels 276 and 278 and extends along the axial centerline of the section 280.

Figure 13:
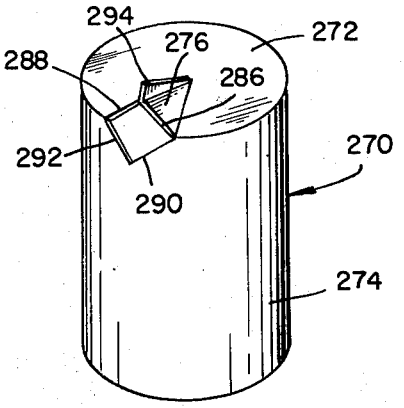
FIG. 13 is a view similar to FIG. 11 of the alternative embodiment illustrated in FIG. 12.

To open the carton 270 an outwardly directed force is exerted on the pull tab 294 resulting in the panels 276 and 278 separating from the side wall 274 along the lines of weakening. The carton walls, since they are formed from a semi-stiff material will deform slightly permitting the panels 276 and 278 to articulate about the centerline of section 280 to create a pour opening as shown in FIG. 13. The panels will remain in their outwardly displaced condition without the need of continually outwardly pulling on the tab.

To close the pour opening an inwardly directed force is exerted on the pull tab 294 resulting in the panels 276 and 278 snapping inwardly so that their edges 286 and 290 are again adjacent the wall 274.

It can be seen from the foregoing detailed description that the object of the present invention, namely to create a carton having an easily openable and closeable pour opening has been achieved by arranging a plurality of walls formed from either a single blank of semi-stiff sheet material or molded from a moldable semi-stiff material to define a container body. One of the plurality of walls of the container body has a section created from a pair of panels. The section has a gradually deepening infolded V shape beginning from a point within the wall. The section extends to an intersecting adjacent wall and is deepest at the intersecting adjacent wall. A pull tab extends along the axial centerline of the section. In one embodiment wherein the carton is formed by folding a single carton blank the panels are secured to the intersecting adjacent wall by closure tabs which are attached to the adjacent wall along lines of weakening. In alternative embodiments wherein the carton is formed by molding, the panels are attached directly to the adjacent wall along lines of weakening.

To open the carton an outwardly directed force is exerted on the pull tab and the tabs, or in the alternative embodiments, the panels will separate from the intersecting adjacent wall along the lines of weakening. The panels will articulate outwardly about the centerline of the section to form a pour opening in the carton. Because the carton material is semi-stiff the panels will remain in the outwardly displaced condition without continual pulling on the pull tab.

To close the opening, an inwardly directed force is exerted on the pull tab and the second portion will articulate inwardly about the centerline of the section and will snap back to return the section to its infolded V shape.

While in accordance with the patent statutes preferred and alternative embodiments of the present invention have been illustrated and described in detail, it is to be particularly understood that the invention is not limited thereto or thereby.

What is claimed is:

1. A carton formed from a single carton blank of semi-stiff sheet material, said carton comprising:

a. a pair of side wall panels, each of said side wall panels having an upper edge;

b. a first end wall panel having an upper edge and a width of a constant dimension;

c. a second end wall panel having an upper edge;

d. bottom closure flap means arranged with said pair of side wall panels and said first and second end wall panels to define a portion of a container body;

e. flap means joined to said pair of side wall panels and arranged to define a top wall of said container body, said top wall having a first section and a second section, said first section being flat and being located adjacent said edge of said second end wall panel, said second section having an infolded V shape of varying depth, being deepest immediately adjacent said upper edge of said first end wall panel and having an axial centerline said second section adapted to articulate about said axial centerline to assume an inverted V shape;

f. a pull tab means associated with said second section; and g. a pair of tabs, each of said tabs attached to said upper edge of said first end wall panel along a line of weakening, each of said pair of tabs adapted to be secured to said second section of said top wall, said pair of tabs separating from said first end wall panel along said lines of weakening when an upwardly directed force is first exerted on said pull tab means and said second section articulating about said axial centerline to assume an inverted V shape to form a pour opening in said first end wall panel and said top wall, said second section returning to its infolded V shape to close said pour opening when a downwardly directed force is exerted on said pull tab means.

2. The carton in accordance with claim 1 wherein said flap means comprises:

a. a first top closure flap adjoining one of said pair of side wall panels along said upper edge, said first top closure flap having an first portion adjacent said second end wall panel and a second portion adjacent said first end wall panel having an edge of a length greater than one half said width of said first end wall panel and an oblique fold line extending from said edge toward a transverse edge of said first portion, said transverse edge having a length equal to one half said width of said first end wall panel;

b. a second top closure flap adjoining the other of said pair of side wall panels along said upper edge, said second top closure flap having a first portion adjacent said second end wall panel and a second portion adjacent said first end wall panel having an edge of a length greater than one half said width of said first end wall panel and equal to said length of said edge of said second portion of said first top closure panel and an oblique fold line extending from said edge toward a transverse edge of said first portion, said transverse edge having a length equal to one half said width of said first end wall panel;

c. said first portion of said first and second top closure flaps being in registry to form said first section in said top wall and said second portions of said first and second top closure flaps abutting and joined along said oblique fold lines to form said second section of said top wall, said oblique fold lines lying on said axial centerline of said second section, said edges of said second portions being adjacent said lines of weakening when said second section is in its infolded V shape.

3. The carton in accordance with claim 2 wherein said pull tab means comprises a pair of strips, one of said strips attached to said second portion of said first top closure flap along said oblique fold line and the other of said pair of strips attached to said second portion of said second top closure flap, said second portion being adhesively joined by said strips.

4. The carton in accordance with claim 2 further comprising a top closure panel adjoining said second end wall panel along said upper edge and adapted for joinder to said first portion of said first and second top closure flaps.

5. A carton comprising:

a. a plurality of walls arranged to define a container body;

b. a pair of hinged panels in one of said plurality of walls to form when said container body is closed, an infolded V-shaped section in said one wall extending from a point within said one wall to another of said plurality of walls intersecting and adjacent said one wall, said infolded V-shaped section having its greatest depth immediately adjacent said another of said plurality of walls and having an axial centerline said panels constructed and arranged to articulate about said axial centerline to assume an inverted V shape;

c. an edge of said another of said plurality of walls immediately adjacent said infolded V-shaped section, V-shaped to conform to said infolded V-shaped section;

d. a pull tab means associated with said section; and e. means providing lines of weakening securing said pair of panels to said another of said plurality of walls, said pair of panels separating from said another of said plurality of walls along said lines weakening when a force outwardly directed with respect to the interior of said container body is exerted on said pair of panels, said pair of panels articulating about said axial centerline to assume in inverted V-shape to form a pour opening in said container body, said pair of panels returning to their infolded V-shape to close said pour opening when a force inwardly directed with respect to the interior of said container body is exerted on said pair of panels.

6. The carton in accordance with claim 5 wherein said carton is formed from a single carton blank of semi-stiff sheet material.

7. The carton in accordance with claim 5 wherein said carton is formed from a moldable material.

8. The carton in accordance with claim 5 wherein said plurality of wall panels are arranged in the form of a rectanguloid.

9. The carton in accordance wih claim 5 wherein said plurality of walls are arranged to form a right circular cylindrical container body.

10. The carton in accordance with claim 9 wherein said one wall of said plurality of walls is a right circular cylindrical side wall and said another of said plurality of walls is a top wall.

11. The carton in accordance with claim 9 wherein said one wall of said plurality of walls is a top wall and said another of said plurality of walls is a right circular cylindrical side wall.

* * * * *